US008892009B2

(12) United States Patent
Furuya et al.

(10) Patent No.: US 8,892,009 B2
(45) Date of Patent: Nov. 18, 2014

(54) DEVELOPING DEVICE, IMAGE FORMING APPARATUS AND IMAGE FORMING METHOD

(71) Applicant: Fuji Xerox Co., Ltd., Tokyo (JP)

(72) Inventors: Nobumasa Furuya, Kanagawa (JP); Sakae Yoshioka, Kanagawa (JP); Jun Abe, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 10 days.

(21) Appl. No.: 13/753,052

(22) Filed: Jan. 29, 2013

(65) Prior Publication Data

US 2014/0023409 A1 Jan. 23, 2014

(30) Foreign Application Priority Data

Jul. 19, 2012 (JP) ..... 2012-160813

(51) Int. Cl.
*G03G 15/09* (2006.01)
*G03G 13/09* (2006.01)

(52) U.S. Cl.
CPC ..... *G03G 15/0921* (2013.01); *G03G 13/09* (2013.01)
USPC ..... 399/269; 399/277

(58) Field of Classification Search
USPC ..... 399/269, 267, 277
See application file for complete search history.

(56) References Cited

U.S. PATENT DOCUMENTS

2007/0172262 A1* 7/2007 Okada et al. ..... 399/269
2007/0212123 A1* 9/2007 Kabashima ..... 399/269

FOREIGN PATENT DOCUMENTS

GB 2 141 048 A * 12/1984
JP 2005-258315 A * 9/2005
JP A-2007-047639 2/2007

* cited by examiner

*Primary Examiner* — Sophia S Chen
(74) *Attorney, Agent, or Firm* — Oliff PLC

(57) ABSTRACT

Provided is a developing device including a pair of developer holding members that include a pair of cylinder members, which are disposed close to each other and rotate in the same direction at an adjacent gap at which both cylinder members are in close proximity, and a pair of magnetic force generation sections which are provided inside the pair of cylinder members respectively and generate magnetic forces for holding a developer on the cylinder members, and a pair of developing magnetic poles that are provided in the pair of magnetic force generation sections respectively, are disposed to be opposed to a latent image holding member, and are set to have the same polarity.

9 Claims, 10 Drawing Sheets

DEVELOPING DEVICE, IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2012-160813 filed Jul. 19, 2012.

BACKGROUND

Technical Field

The present invention relates to a developing device, an image forming apparatus and an image forming method.

SUMMARY

According to an aspect of the invention, there is provided a developing device including: a pair of developer holding members that include a pair of cylinder members, which are disposed close to each other and rotate in the same direction at an adjacent gap at which both cylinder members are in close proximity, and a pair of magnetic force generation sections which are provided inside the pair of cylinder members respectively and generate magnetic forces for holding a developer on the cylinder members; and a pair of developing magnetic poles that are provided in the pair of magnetic force generation sections respectively, are disposed to be opposed to a latent image holding member, and are set to have the same polarity.

BRIEF DESCRIPTION OF THE DRAWINGS

Exemplary embodiments of the present invention will be described in detail based on the following figures, wherein:

FIG. 7A is a graph illustrating relationships between a developing nip width and an amount of toner per unit area MOS developed onto the photoconductor by the reverse rotation developing roller, and FIG. 7B is a graph illustrating relationships between MOS and developing performance DQA;

DETAILED DESCRIPTION

Figure 1:
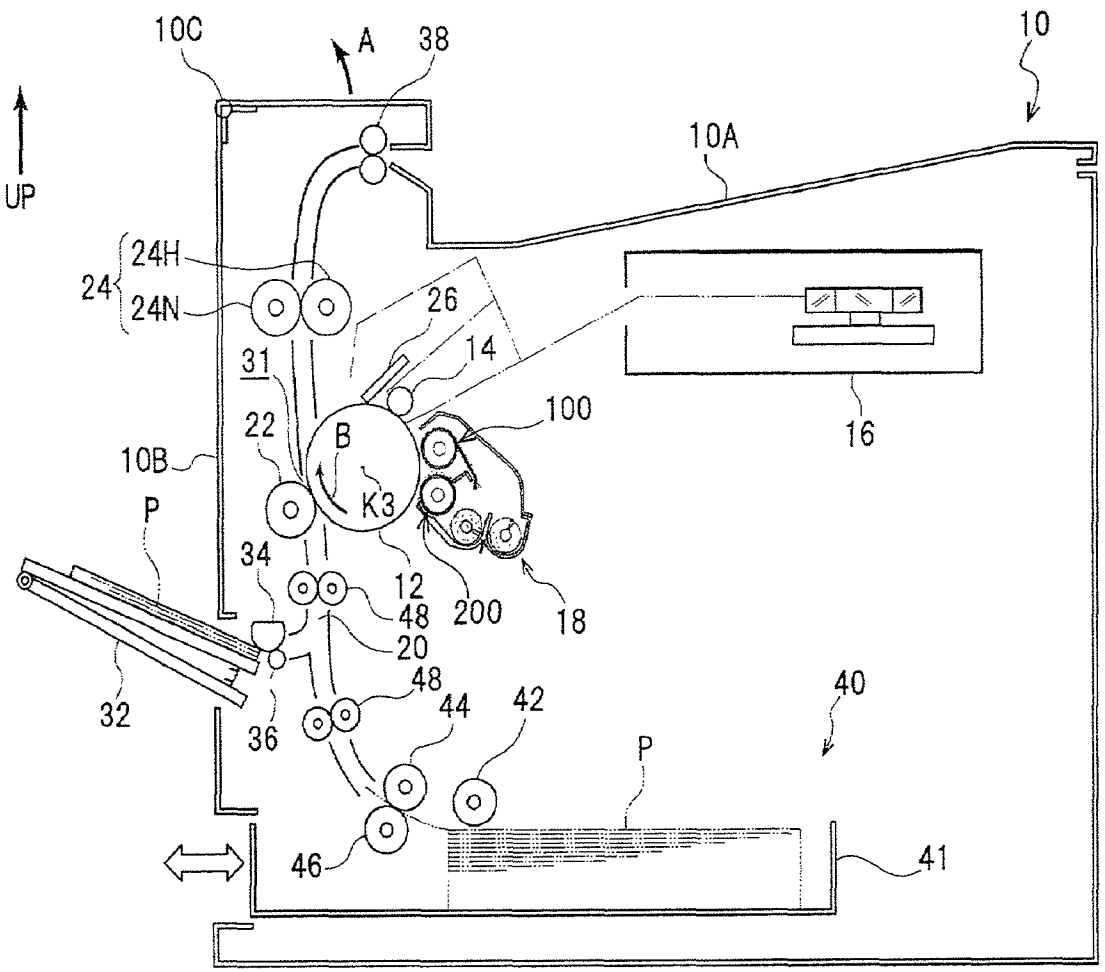
FIG. 1 is a configuration diagram illustrating a configuration of an image forming apparatus according to an exemplary embodiment of the present invention.

Examples of a developing device and an image forming apparatus according to an exemplary embodiment of the present invention will be described with reference to FIGS. 1 to 5.

It should be noted that the arrow UP shown in the drawing indicates the upper side in the vertical direction.

Image Forming Apparatus

First, an overall configuration of the image forming apparatus will be described with reference to FIG. 1.

As shown in FIG. 1, the image forming apparatus 10 includes: a photoconductor 12 that has a drum shape as an example of a latent image holding member; a charging device 14 that charges a surface of the photoconductor 12; an exposure device 16 that irradiates the photoconductor 12 with laser light on the basis of image data so as to form an electrostatic latent image; a developing device 18 that selectively transfers the toner onto the electrostatic latent image and visualizes the toner as a toner image; a transfer roller 22 that is an example of a transfer section for transferring the toner image on the surface of the photoconductor 12 onto the sheet member P as an example of a transfer target object (printing medium) supplied along the transport path 20; a fixing device 24 that heats and presses the toner image on the sheet member P so as to fix the image onto the sheet member P; and a cleaning device 26 that cleans the toner which remains on the photoconductor 12 after the transfer of the toner image. It should be noted that the developing device 18 (refer to FIG. 2) will be described later in detail.

Further, the image forming apparatus 10 is covered by a main body side cover 10B and a top board 10A. In addition, a shaft 100, which rotatably connects the top board 10A to the main body side cover 10B, is provided on the corner portion of the upper end of the main body side cover 10B, and the top board 10A is rotated about the shaft 100 as the rotation center in the direction of the arrow A, thereby opening the inside of the image forming apparatus 10. Then, the top board 10A of the image forming apparatus 10 is opened, and various maintenance works (such as replenishment of a developer G and replacement of each member) may be performed.

Furthermore, a sheet feeding device 40, which feeds the sheet members P one by one, is provided on the lower side inside the image forming apparatus 10. The sheet feeding device 40 includes a sheet feeding member 41 on which the plural sheet members P are stacked. The sheet members P, which are stacked on the sheet feeding member 41, are picked up one by one by a pickup roller 42, and are transported one by one by a sheet feeding roller 44, which is driven to be rotated, and a separating roller 46 which is provided in the sheet feeding member 41.

Moreover, plural transport rollers 48 are provided along the transport path 20 of the sheet member P, and transport the sheet member P to the downstream side in the transport direction of the sheet member P (hereinafter simply referred to as the downstream side) along the transport path 20.

Further, the above-mentioned fixing device 24 is provided downstream of the transport path 20. The fixing device 24 includes a heating roller 24H and a pressing roller 24N, and fixes the toner image, which is formed on the sheet member P, onto the sheet member P by passing the sheet member P between the heating roller 24H and the pressing roller 24N.

Furthermore, a discharging roller 38, which discharges the sheet member P having the toner image fixed thereon onto the upper surface of the top board 10A, is provided downstream of the fixing device 24.

Moreover, a manual sheet feeding tray 32 for manually supplying the sheet member P is provided on the side of the image forming apparatus 10. A meniscus feed-out roller 34 is provided on the manual sheet feeding tray 32, and a separating roller 36 is provided near the feed-out roller 34 with the sheet member P being interposed therebetween.

The separating roller 36 is supported by the supporting member which is provided on both end portions and is not shown, and is urged toward the feed-out roller 34 by elastic force of a coil spring or the like provided in the supporting member. With such a configuration, when the feed-out roller 34 is rotated, the sheet members P loaded on the manual sheet feeding tray 32 are sent to the transport path 20 by the feed-out roller 34 and the separating roller 36 one by one.

Image Formation Process

Next, the image formation process of the image forming apparatus 10 will be described.

First, the charging device 14 charges the surface of the photoconductor 12. Subsequently, the exposure device 16 exposes the charged surface of the photoconductor 12 on the basis of image data, which is read by a scanner not shown in drawing, and data which is sent from the outside, thereby forming an electrostatic latent image on the surface of the photoconductor 12. Then, the developing device 18 develops the electrostatic latent image so as to visualize the image as a toner image.

On the other hand, the sheet member P is fed out from the sheet feeding member 41 or the manual sheet feeding tray 32 to the transport path 20. The sheet member P, which is fed out to the transport path 20, passes a transfer section 31 which is formed between the transfer roller 22 and the photoconductor 12 holding the toner image, thereby transferring the toner image onto the sheet member P through the transfer roller 22. The toner image, which is transferred onto the sheet member P, passes between the pressing roller 24N and the heating roller 24H of the fixing device 24, and is thereby fixed onto the sheet member P. The sheet member P, onto which the toner image is fixed, is discharged onto the upper surface of the top board 10A by the discharging roller 38.

Developing Device

Next, the configuration of the developing device 18 will be described. It should be noted that the rotation direction of the photoconductor 12 is indicated by the arrow B, the rotation direction of the reverse rotation developing roller 100 to be described later is indicated by the arrow C, and the rotation direction of the forward rotation developing roller 200 to be described later is indicated by the arrow D.

Figure 2:
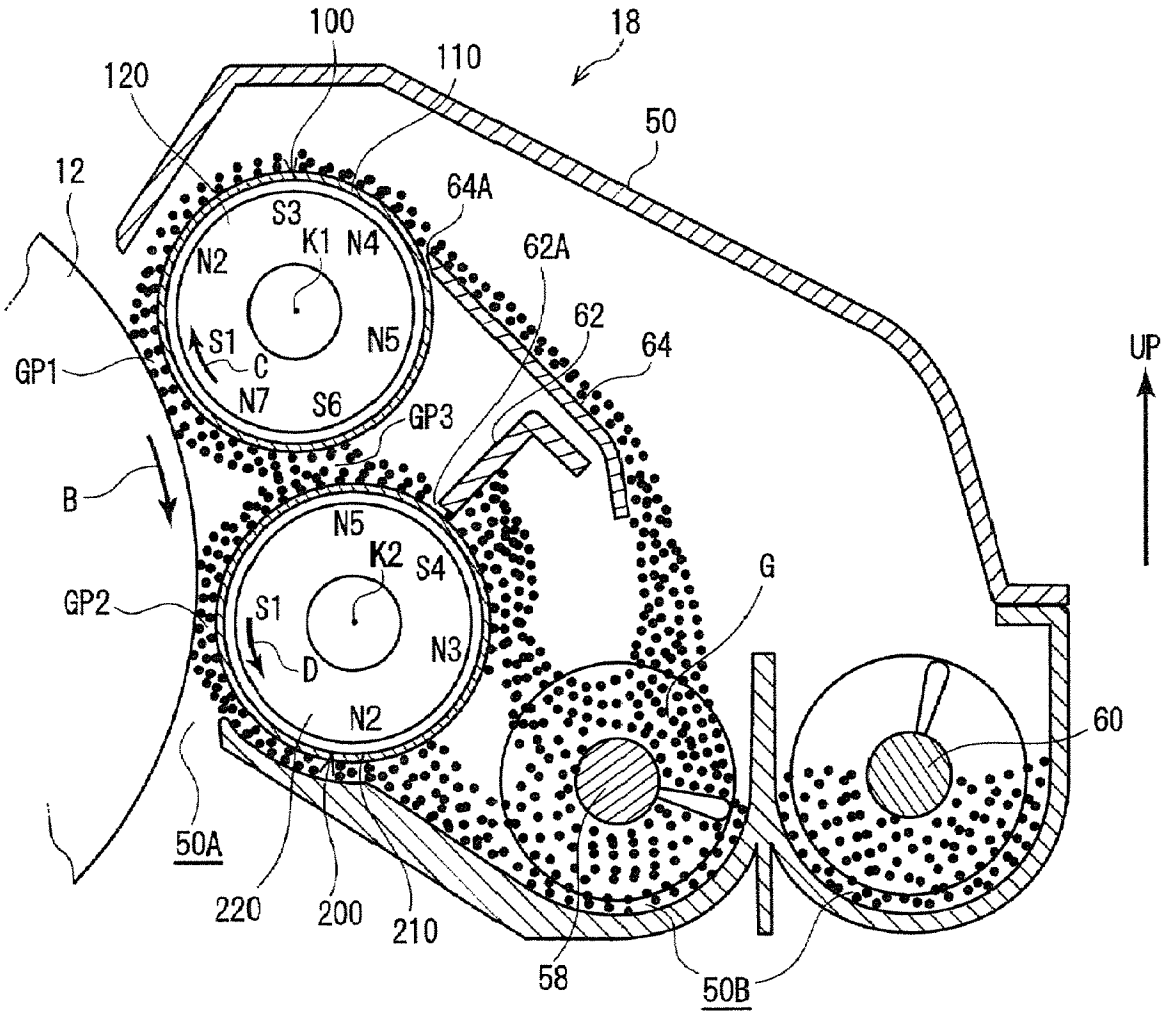
FIG. 2 is a configuration diagram illustrating a configuration of a developing device, provided in the image forming apparatus shown in FIG. 1, according to an exemplary embodiment of the present invention.

As shown in FIG. 2, the developing device 18 includes a casing 50 that has an opening portion 50A provided at a position opposed to the photoconductor 12. Inside the casing 50, the reverse rotation developing roller 100 and the forward rotation developing roller 200 as an example of the pair of developer holding members are provided close to each other in the vertical direction.

The reverse rotation developing roller 100 is disposed to be opposed to the surface (outer circumferential surface) of the photoconductor 12, and is rotated in a direction (C direction) reverse to a rotation direction (B direction) of the photoconductor 12, at a portion GP1 opposed to the photoconductor 12. In contrast, the forward rotation developing roller 200 is disposed to be opposed to the surface (outer circumferential surface) of the photoconductor 12, downstream in the rotation direction (B direction) of the photoconductor 12 of the reverse rotation developing roller 100, and is rotated in a direction (D direction) the same as the rotation direction (B direction) of the photoconductor 12, at the portion GP2 opposed to the photoconductor 12. Further, the reverse rotation developing roller 100 and the forward rotation developing roller 200 are rotated such that their movement directions are the same at the adjacent gap GP3 disposed close to each other in the vertical direction (the reverse rotation developing roller 100 and the forward rotation developing roller 200 will be described in detail later).

In a containing space 50B that is provided on the lower side inside the casing 50 and contains the developer G, a first stirring transport member 58 and a second stirring transport member 60, which transport the developer G to the forward rotation developing roller 200, are provided.

The first stirring transport member 58 and the second stirring transport member 60 are arranged side by side so as to circulate the developer G in plan view on the lower side (the lower right side of the drawing) of the forward rotation developing roller 200. Then, by rotating the first stirring transport member 58 and the second stirring transport member 60, the developer G is stirred, and concurrently transported along the direction of the rotation shaft of the forward rotation developing roller 200, and the developer G is supplied to the forward rotation developing roller 200. It should be noted that the developer G used in the developing device 18 is formed as a two-component developer constituted of magnetic carrier particles and a toner made of resin.

A layer formation member 62 is provided upstream of the adjacent gap GP3 on the forward rotation developing roller 200 in the rotation direction (D direction). The layer formation member 62 is a plate member of which the sectional shape is rectangular in the normal line direction of the outer circumference of the forward rotation developing roller 200, and one end face 62A of the section of the rectangular shape is disposed to face the surface of the forward rotation developing roller 200 with a space interposed therebetween. Then, by passing the developer G between the layer formation member 62 and the forward rotation developing roller 200, the thickness of the layer of the developer G held by the forward rotation developing roller 200 is smoothed.

A guide plate 64 is disposed above the layer formation member 62. The guide plate 64 is disposed such that the leading end portion 64A thereof is opposed to the reverse rotation developing roller 100, and extends from the leading end portion 64A obliquely toward the first stirring transport member 58 which is on the lower side of the guide plate 64. In addition, the guide plate 64 guides the developer G, which is dropped out from the reverse rotation developing roller 100, toward the containing space 50B. That is, the developer G, which is dropped out from the reverse rotation developing roller 100, is not directly adhered onto the forward rotation developing roller 200, and is guided toward the containing space 50B.

Configuration of Reverse Rotation Developing Roller 100 and Forward Rotation Developing Roller 200

Next, configuration of the reverse rotation developing roller 100 and the forward rotation developing roller 200 will be described later in detail. It should be noted that, in the following description of each magnetic pole, "S" means the S pole, and "N" means the N pole.

The reverse rotation developing roller 100 has a magnet roller (magnetic roller) 120 as an example of the magnetic force generation section constituted of a developing sleeve 110, which has a substantially cylindrical shape, as an example of the cylinder member and plural magnetic poles which are provided inside the developing sleeve 110. Likewise, the forward rotation developing roller 200 also has a magnet roller (magnetic roller) 220 as an example of the magnetic force generation section constituted of a developing sleeve 210, which has a substantially cylindrical shape, as an example of the cylinder member and plural magnetic poles which are provided inside the developing sleeve 210. Further, the developing sleeve 110 of the reverse rotation developing roller 100 and the developing sleeve 210 of the forward rotation developing roller 200 are disposed to face each other at a close distance in the vertical direction with a space formed between the outer circumferential surfaces thereof, and the space, in which the developing sleeve 110 and the developing sleeve 210 face each other, is the above-mentioned adjacent gap GP3.

The developing sleeve 110 of the reverse rotation developing roller 100 is disposed such that the direction of the rotation shaft thereof faces the surface of the photoconductor 12 along the direction of the rotation shaft of the photoconductor 12, and is rotated such that the movement direction (C direction) thereof at the portion GP1 opposed to the photoconductor 12 is reverse to that of the photoconductor 12. Further, the magnet roller 120 is disposed inside the developing sleeve 110, and a magnetic field, which is distributed circumferentially outside the developing sleeve 110 by the plural magnetic poles circumferentially arranged, is formed (refer to FIG. 3).

Figure 3:
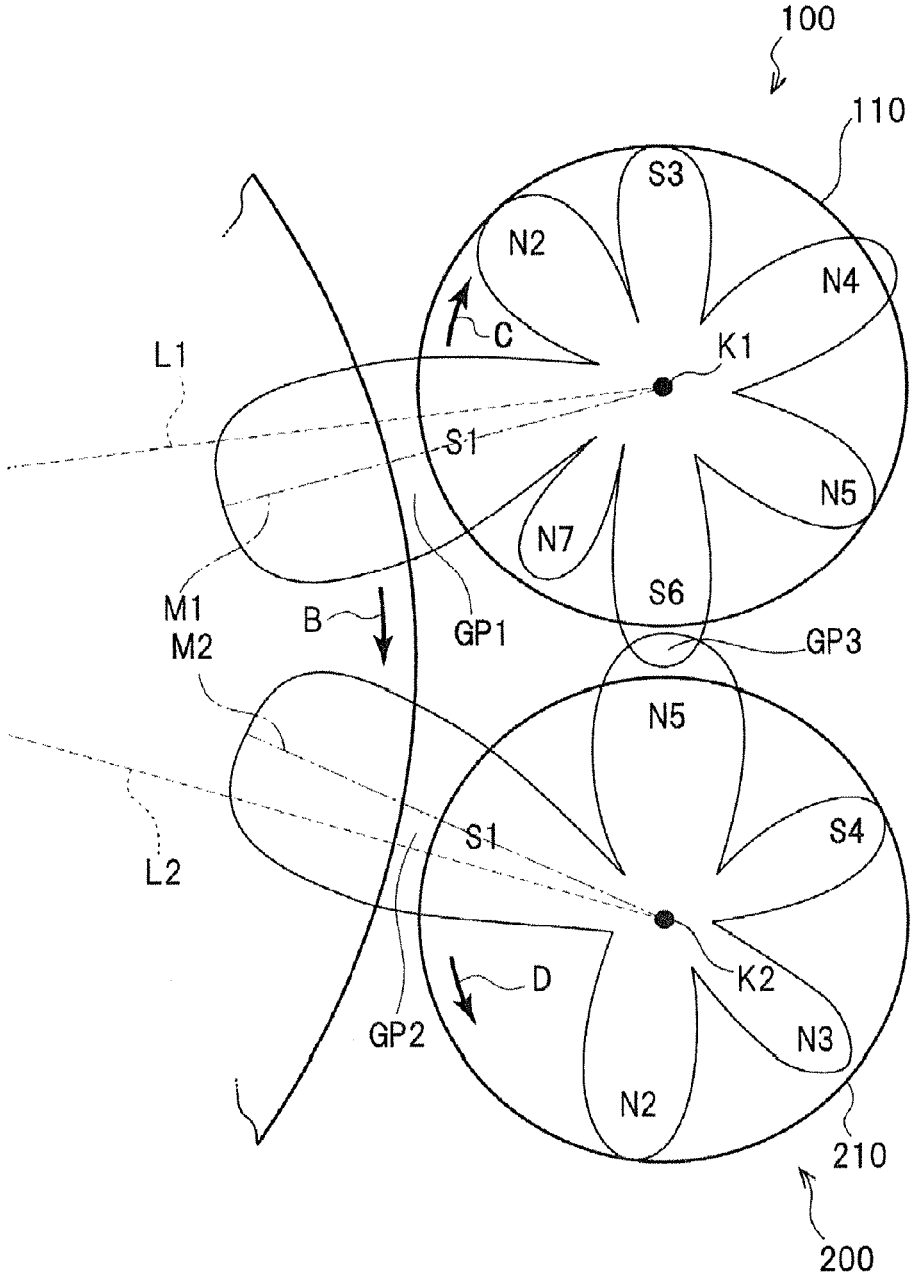
FIG. 3 is a magnetic flux density distribution diagram illustrating distribution of magnetic flux density of the forward rotation developing roller and the reverse rotation developing roller of the developing device shown in FIG. 2.

As shown in FIGS. 2 and 3, in the magnet roller 120 of the reverse rotation developing roller 100, a magnetic pole S1, a magnetic pole N2, a magnetic pole S3, a magnetic pole N4, a magnetic pole N5, a magnetic pole S6, and a magnetic pole N7, which are constituted as seven permanent magnets of which the S pole or N pole is formed on the surface side of the magnet roller 120 along the circumferential direction of the developing sleeve 110, are radially provided. Further, in the reverse rotation developing roller 100, the magnetic pole S1, which is the developing magnetic pole (developing main pole), is disposed at the portion GP1 opposed to the photoconductor 12. In addition, the reverse rotation developing roller 100 develops the electrostatic latent image of the photoconductor 12 through the developer G by bringing the developer G in contact with the photoconductor 12 at the portion GP1 opposed to the photoconductor 12.

The magnetic pole N2 and the magnetic pole S3 for transporting the developer G are disposed next to the downstream side of the magnetic pole S1 in the rotation direction (C direction). Further, the magnetic pole N4 and the magnetic pole N5 for picking off the developer G are arranged side by side next thereto. Furthermore, the magnetic pole S6, which is the delivery magnetic pole, is disposed next to the magnetic pole N5. In addition, the magnetic pole S6 is disposed at the portion corresponding to the adjacent gap GP3. In addition, the magnetic pole N7 for transporting the developer G is disposed between the magnetic pole S6 and the magnetic pole S1.

On the other hand, as shown in FIG. 2, the developing sleeve 210 of the forward rotation developing roller 200 is disposed to face the surface of the photoconductor 12 such that the direction of the rotation shaft thereof follows the direction of the rotation shaft of the photoconductor 12. However, the roller is rotated such that the movement direction (D direction) at the portion GP2 opposed to the photoconductor 12 of the developing sleeve 210 is the same as that of the photoconductor 12. Further, the magnet roller 220 is disposed inside the developing sleeve 210, and the magnetic field, which is circumferentially distributed outside the developing sleeve 210, is formed by the plural magnetic poles arranged in the circumferential direction (refer to FIG. 3).

As shown in FIGS. 2 and 3, in the magnet roller 220 of the forward rotation developing roller 200, a magnetic pole S1, a magnetic pole N2, a magnetic pole N3, a magnetic pole S4, and a magnetic pole N5, which are constituted as five permanent magnets of which the S pole or N pole is formed on the surface side of the magnet roller 220 along the circumferential direction of the developing sleeve 210, are radially provided. Further, in the forward rotation developing roller 200, the magnetic pole S1, which is the developing magnetic pole (developing main pole), is disposed at the portion GP2 opposed to the photoconductor 12. In addition, the forward rotation developing roller 200 develops the electrostatic latent image of the photoconductor 12 through the developer G by bringing the developer G in contact with the photoconductor 12 at the portion GP2 opposed to the photoconductor 12.

The magnetic pole N2 for transporting and picking off the developer G is disposed next to the magnetic pole S1 in the rotation direction (D direction), above-mentioned picking-off is caused by repulsive magnetic field generated by the magnetic poles N2 and N3, the magnetic pole N3 for picking up the developer G is disposed next to the magnetic pole N2, and the magnetic pole S4 for transporting the developer G is disposed next thereto. In addition, the magnetic pole N5, which is the delivery magnetic pole, is disposed next to the magnetic pole S4. The magnetic pole N5 is disposed to be opposed to the magnetic pole S6 which is the delivery magnetic pole of the above-mentioned reverse rotation developing roller 100 at the portion corresponding to the adjacent gap GP3.

It should be noted that, as shown in FIGS. 2 and 3, in the exemplary embodiment, the magnetic pole S1, which is the developing magnetic pole of the reverse rotation developing roller 100, and the magnetic pole S1, which is the developing magnetic pole of the forward rotation developing roller 200, have the same polarity (S pole).

FIG. 3 is a schematic diagram of magnetic flux density distribution (the magnitude of the magnetic flux density) of the reverse rotation developing roller 100 and the forward rotation developing roller 200. Further, a straight line, which passes through the rotation center K1 of the developing sleeve 110 of the reverse rotation developing roller 100 and the rotation center K3 of the photoconductor 12 (refer to FIG. 1), is indicated by the virtual straight line L1. In addition, a straight line, which passes through the rotation center K2 of the developing sleeve 210 of the forward rotation developing roller 200 and the rotation center K3 of the photoconductor 12 (refer to FIG. 1), is indicated by the virtual straight line L2.

In the exemplary embodiment, the center position (center line) M1 of the magnetic pole S1, which is the developing magnetic pole of the reverse rotation developing roller 100, is disposed to be shifted upstream of the virtual straight line L1 in the rotation direction C. Likewise, the center position (center line) M2 of the magnetic pole S1, which is the developing magnetic pole of the forward rotation developing roller 200, is disposed to be shifted upstream of the virtual straight line L2 in the rotation direction D.

Further, the magnetic pole S1, which is the developing magnetic pole of the reverse rotation developing roller 100, and the magnetic pole S1, which is the developing magnetic pole of the forward rotation developing roller 200, are formed as magnetic poles of which each angle α at the half-value width is as wide as 30° or more.

Figure 4:
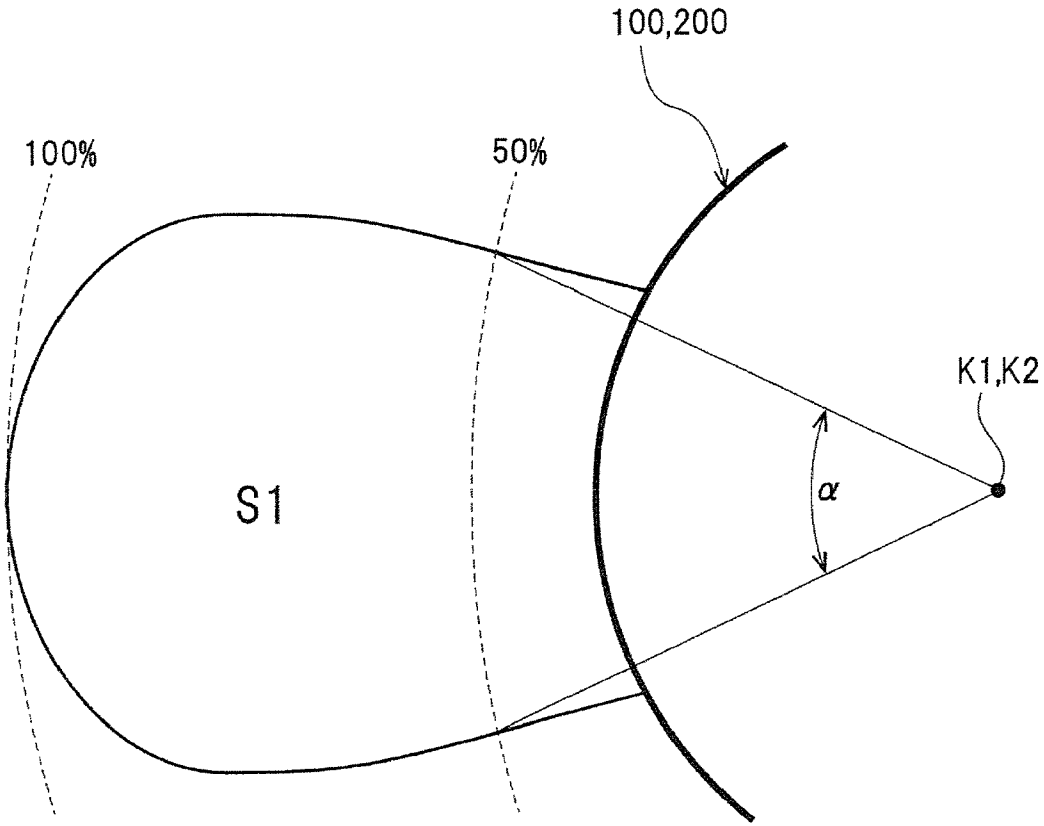
FIG. 4 is an explanatory diagram illustrating half-value widths of the developing magnetic poles of the forward rotation developing roller and the reverse rotation developing roller of the developing device shown in FIG. 2.

It should be noted that "the angle α at the half-value width" is an angular width of the portion indicating a half value of the peak magnetic flux density or the maximum normal line magnetic flux density (vertex) of the magnetic flux density distribution curve in the normal line direction at a magnetic pole (the magnetic pole S1 as the developing magnetic pole in the exemplary embodiment), as shown in FIG. 4.

Next, the effects and the advantages of the exemplary embodiment will be described.

First, transport of the developer G of the developing device 18 will be described.

As shown in FIG. 2, in the developing device 18, the developer G is supplied to the forward rotation developing roller 200 by the first stirring transport member 58 and the second stirring transport member 60. The developer G, which is supplied to the forward rotation developing roller 200, is adhered onto the surface of the developing sleeve 210 by the magnetic pole N3 and the magnetic pole S4. The adhered developer G is transported by rotation (D direction) of the developing sleeve 210, and the layer formation member 62 smoothes the thickness of the layer of the developer G held by the forward rotation developing roller 200. Then, after the thickness of the layer is smoothed, the developer G is divided between the forward rotation developing roller 200 and the reverse rotation developing roller 100 by the magnetic pole N5 and the magnetic pole S6 which are delivery magnetic poles at the adjacent gap GP3. In other words, apart of the developer G is delivered from the forward rotation developing roller 200 to the reverse rotation developing roller 100.

The developer G divided into the reverse rotation developing roller 100 at the adjacent gap GP3 is transported by the rotation (C direction) of the developing sleeve 110 of the reverse rotation developing roller 100. Then, the developer G at the magnetic pole S1 as the developing magnetic pole, that is, toner comes into contact with the photoconductor 12 at the portion GP1, thereby developing the electrostatic latent image of the photoconductor 12 by the toner of the developer G. The developer G is picked off between the magnetic pole N4 and the magnetic pole N5 after the development, and is separated from the surface of the developing sleeve 110. The separated developer G is guided by the guide plate 64, and is returned to the containing space 50B.

In contrast, the developer G divided into the forward rotation developing roller 200 at the adjacent gap GP3 is transported by the rotation (D direction) of the developing sleeve 210. The developer G at the magnetic pole S1 as the developing magnetic pole, that is, the portion GP2 comes into contact with the photoconductor 12, thereby developing the electrostatic latent image of the photoconductor 12 by the toner of the developer G. The developer G is picked off between the magnetic pole N2 and the magnetic pole N3 after the development, is separated and falls from the surface of the developing sleeve 110, and is returned to the containing space 50B.

It should be noted that the forward rotation developing roller 200 develops the toner image (electrostatic latent image) developed by the reverse rotation developing roller 100 again, thereby improving image quality while increasing the total amount of developed toner, compared with the case where the development is performed by only the reverse rotation developing roller 100.

For example, the density decrease portion, which is formed in the vicinity of the leading end portion of the toner image formed by the reverse rotation developing roller 100, is continuously developed through the forward rotation developing roller 200, whereby the toner even at the density decrease portion is developed, and it is possible to obtain an effect that corrects image quality defects. Further, for example, in the toner image formed by the forward rotation developing roller 200, the density decrease portion tends to occur in the vicinity of the tailing end portion thereof. However, first the toner image is formed at the tailing end portion by the reverse rotation developing roller 100, and thus it is possible to obtain an effect that suppresses occurrence of the image quality defects caused by the forward rotation developing roller 200.

Figure 5:
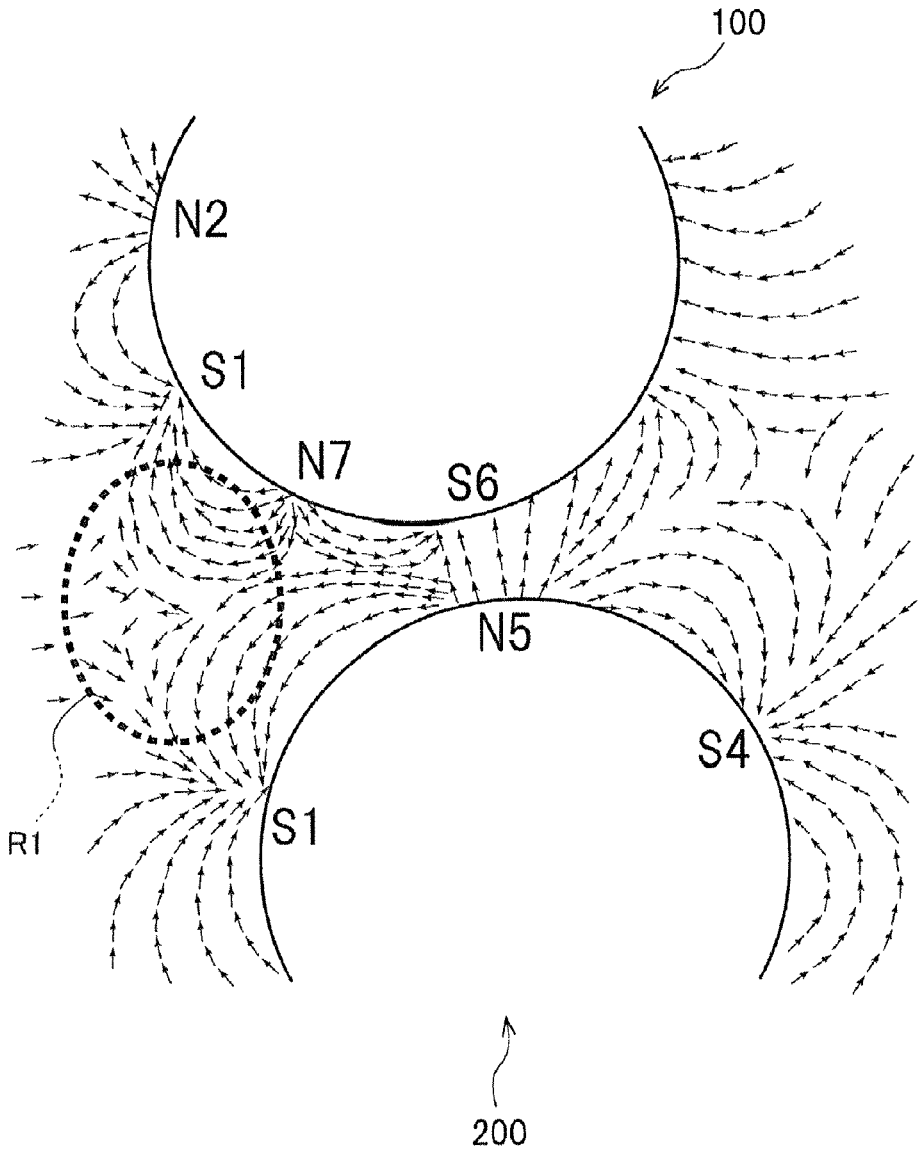
FIG. 5 is a magnetic force line diagram illustrating directions of the magnetic force lines of the forward rotation developing roller and the reverse rotation developing roller of the developing device shown in FIG. 2.

Here, in the exemplary embodiment, the magnetic pole S1, which is the developing magnetic pole of the reverse rotation developing roller 100, and the magnetic pole S1, which is the developing magnetic pole of the forward rotation developing roller 200, have the same polarity. Accordingly, as shown in FIG. 5, the magnetic fields of the magnetic pole (developing magnetic pole) S1 of the reverse rotation developing roller 100 and the magnetic pole (developing magnetic pole) S1 of the forward rotation developing roller 200 are formed in a repulsive direction (refer to R1 of FIG. 5). Accordingly, the magnetic fields formed by the respective magnetic poles (developing magnetic poles) S1 are dominant at the portions GP1 and GP3, and the extending direction of the magnetic brush for the developer G is directed toward the photoconductor 12.

Figure 6:
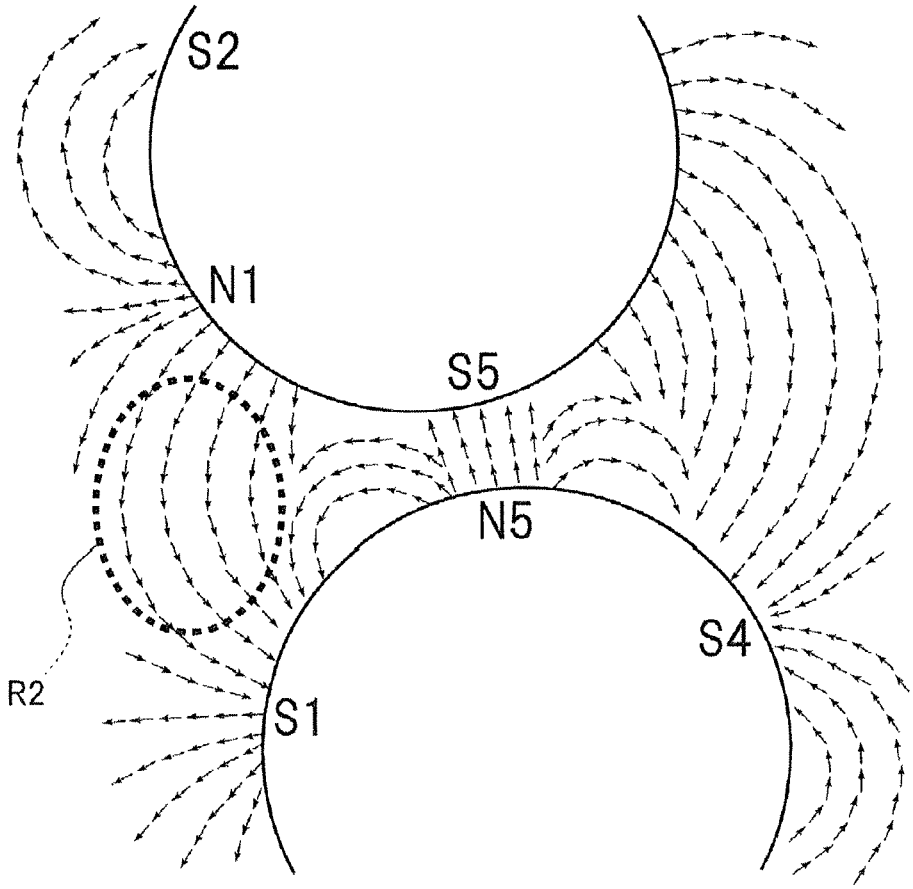
FIG. 6 is a magnetic force line diagram illustrating the directions of the magnetic force lines in a comparative example in which the developing magnetic poles of the forward rotation developing roller and the reverse rotation developing roller have the different polarities, corresponding to FIG. 5.

In contrast, in the case of a comparative example in which the respective developing magnetic poles have different polarities as shown in FIG. 6, the magnetic fields between the developing magnetic pole N1 and the developing magnetic pole S1 corresponding to each other are formed in an attractive direction, and the magnetic fields corresponding to each other are connected between the developing magnetic poles (refer to R2 of FIG. 6). Accordingly, the extending direction of the magnetic brush for the developer G is directed toward not the photoconductor 12 but the developing magnetic poles corresponding to each other.

Accordingly, in a similar manner to the exemplary embodiment, by making the developing magnetic pole (magnetic pole S1) of the reverse rotation developing roller 100 and the developing magnetic pole (magnetic pole S1) of the forward rotation developing roller 200 have the same polarity, compared with the case of the comparative example of FIG. 6 in which the developing magnetic poles have different polarities, the developing nip width (contact width), in which the developer G comes into contact with the photoconductor 12 at the developing magnetic pole (at least one of the portions GP1 and GP2 which are developing portions), in the circumferential direction is increased. Further, the developing nip width (the contact width in the circumferential direction) between the developer G and the photoconductor 12 is increased, and thereby development characteristics are improved (improvement of development characteristics will be described later in detail).

Further, as shown in FIGS. 2, 3, and 5, between the magnetic pole S6 and the magnetic pole S1 having the same polarity, the magnetic pole N7 having a different polarity therefrom is disposed. Thereby, capability to transport the developer G between the magnetic pole S6 and the magnetic pole S1 having the same polarity is improved.

In addition, as shown in FIG. 3, in the exemplary embodiment, the center position (center line) M1 of the magnetic pole S1, which is the developing magnetic pole of the reverse rotation developing roller 100, is disposed to be shifted toward the upstream side of the virtual straight line L1 in the rotation direction C. Likewise, the center position (center line) M2 of the magnetic pole S1, which is the developing magnetic pole of the forward rotation developing roller 200, is also disposed to be shifted toward the upstream side of the virtual straight line L2 in the rotation direction D. Furthermore, the magnetic pole S1 of the reverse rotation developing roller 100 and the magnetic pole S1 of the forward rotation developing roller 200 are formed as magnetic poles of which each angle α at the half-value width is as wide as 30° or more (refer to FIG. 4).

In the case of such a configuration, the magnetic fields respectively formed by the magnetic pole S1, which is the developing magnetic pole of the reverse rotation developing roller 100, and the magnetic pole S1, which is the developing magnetic pole of the forward rotation developing roller 200, are close, and thus the magnetic fields tend to have effects on each other. Therefore, in the case of the comparative example of FIG. 6 in which the developing magnetic poles have different polarities, the phenomenon that the magnetic brushes are directed toward the developing magnetic poles corresponding to each other has a tendency to become further conspicuous. Accordingly, the developing nip width (the contact width in the circumferential direction) between the developer G and the photoconductor 12 is more decreased, and thereby has a tendency to have a greater effect on development characteristics. That is, image defects caused by a small developing nip width (the contact width in the circumferential direction) tend to occur.

Consequently, in such a configuration, by making the developing magnetic pole (magnetic pole S1) of the reverse rotation developing roller 100 and the developing magnetic pole (magnetic pole S1) of the forward rotation developing roller 200 have the same polarity, the developing nip width (the contact width in the circumferential direction) between the developer G and the photoconductor 12 is increased, and the development characteristics are improved. As a result, it is possible to suppress image defects caused by a small developing nip width (the contact width in the circumferential direction).

Detailed Description of Improvement in Developing Characteristics

Next, a description will be given in detail of the case where the developing magnetic pole (magnetic pole S1) of the reverse rotation developing roller 100 and the developing magnetic pole (magnetic pole S1) of the forward rotation developing roller 200 have the same polarity, whereby the developing nip width (the contact width in the circumferential direction) between the developer G and the photoconductor 12 is increased, and development characteristics are improved.

First, a description will be given of development characteristics in the case of the developing device that has only the reverse rotation developing roller (the case where the forward rotation developing roller is not provided).

Figure 7A:
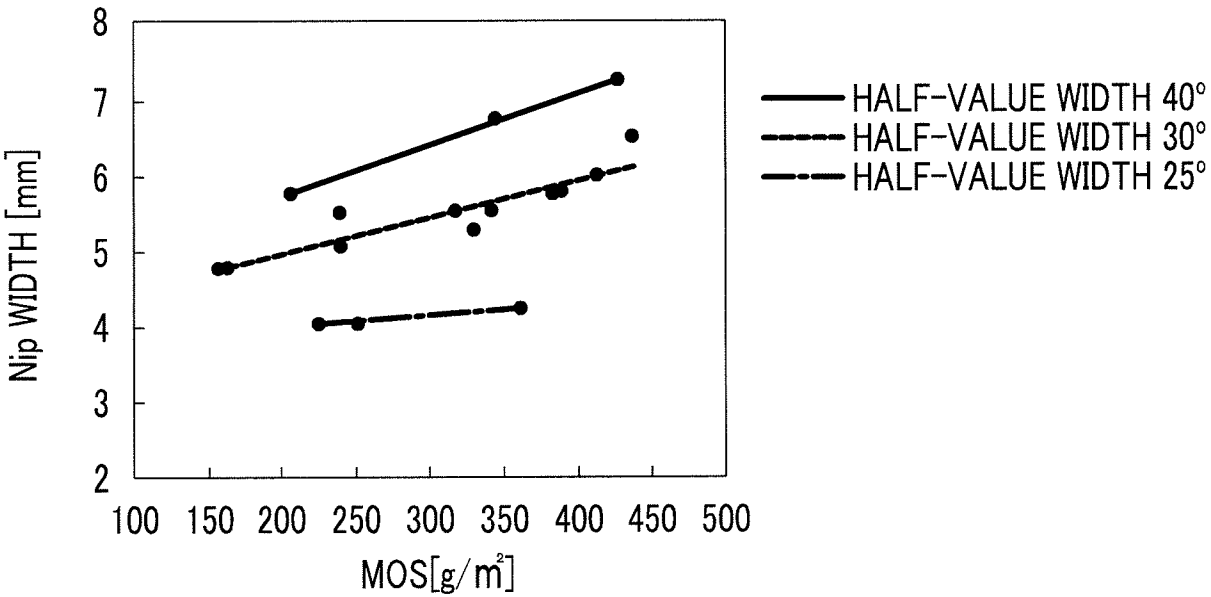
FIGS. 7A and 7B are graphs of the half-value widths of the developing magnetic poles set to 40°, 30°, and 25° in the configuration in which the reverse rotation developing roller is provided, where

FIG. 7A shows relationships between the weight per unit area MOS (g/m$^2$) of the developer, which is held on the reverse rotation roller 100, and the developing nip width (mm), which is a contact width of contact between the magnetic brush and the photoconductor surface on the circumferential surface of the photoconductor in the circumferential direction, when the half-value width (refer to FIG. 4) of the developing magnetic pole of the reverse rotation developing roller is 40°, 30°, and 25°.

Figure 7B:
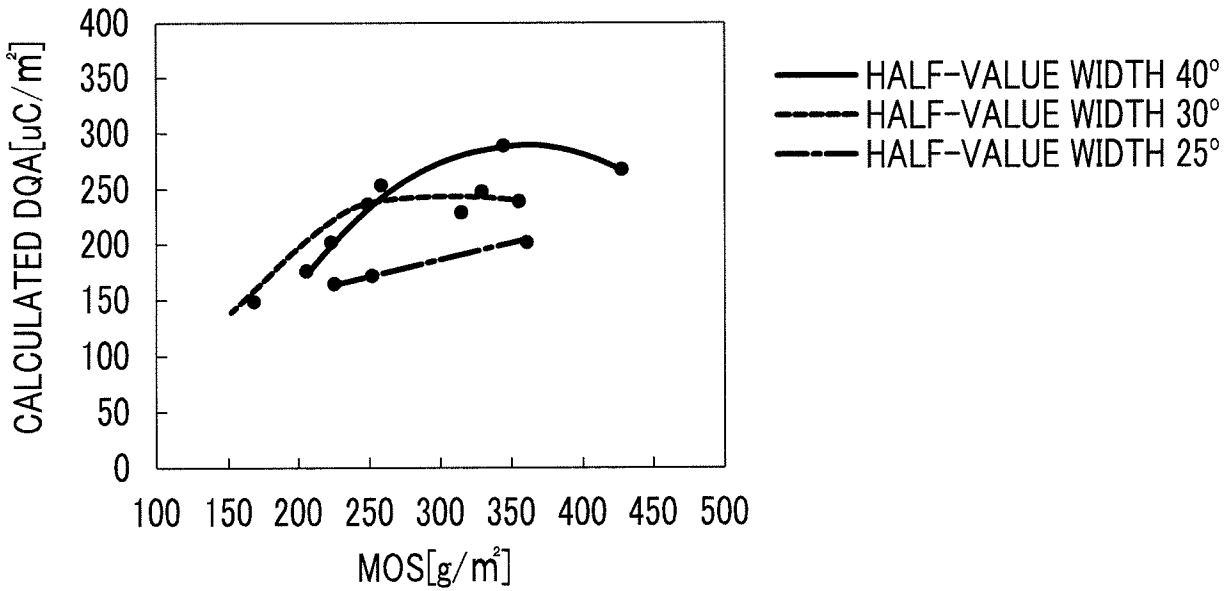

Further, FIG. 7B shows relationships between the MOS (g/m) and the developing performance DQA (μC/m$^2$) when the half-value width (refer to FIG. 4) of the developing magnetic pole of the reverse rotation developing roller is 40°, 30°, and 25°.

It should be noted that the DQA (μC/m$^2$) is a charge amount per unit area of the toner adhered (developed) onto the photoconductor, and is obtained by a product of the developed toner weight (DMA) and the toner charge amount (Q/m). In addition, the DQA (μC/m$^2$) is set as one of indicators of the development characteristics, and the developing performance becomes better as the DQA becomes larger.

It can be seen from FIGS. 7A and 7B that, as the half-value width of the developing magnetic pole is larger, the DQA is larger, and the developing performance is improved. Further, the half-value width of the developing magnetic pole is correlated with the developing nip width (the contact width in the circumferential direction). Thus, by increasing the half-value width, the developing nip width is increased. As a result, the developing performance is improved.

Next, a description will be given of respective development characteristics of a configuration (hereinafter referred to as "1-MAG") having only the reverse rotation developing roller, a configuration (hereinafter referred to as "homopolar 2-MAG") of the reverse rotation developing roller 100 and the forward rotation developing roller 200 in which the developing magnetic poles have the same polarity in the exemplary embodiment, and the case (hereinafter referred to as "heteropolar 2-MAG") of the comparative example of FIG. 6 in which the above mentioned developing magnetic poles have different polarities.

Figure 8:
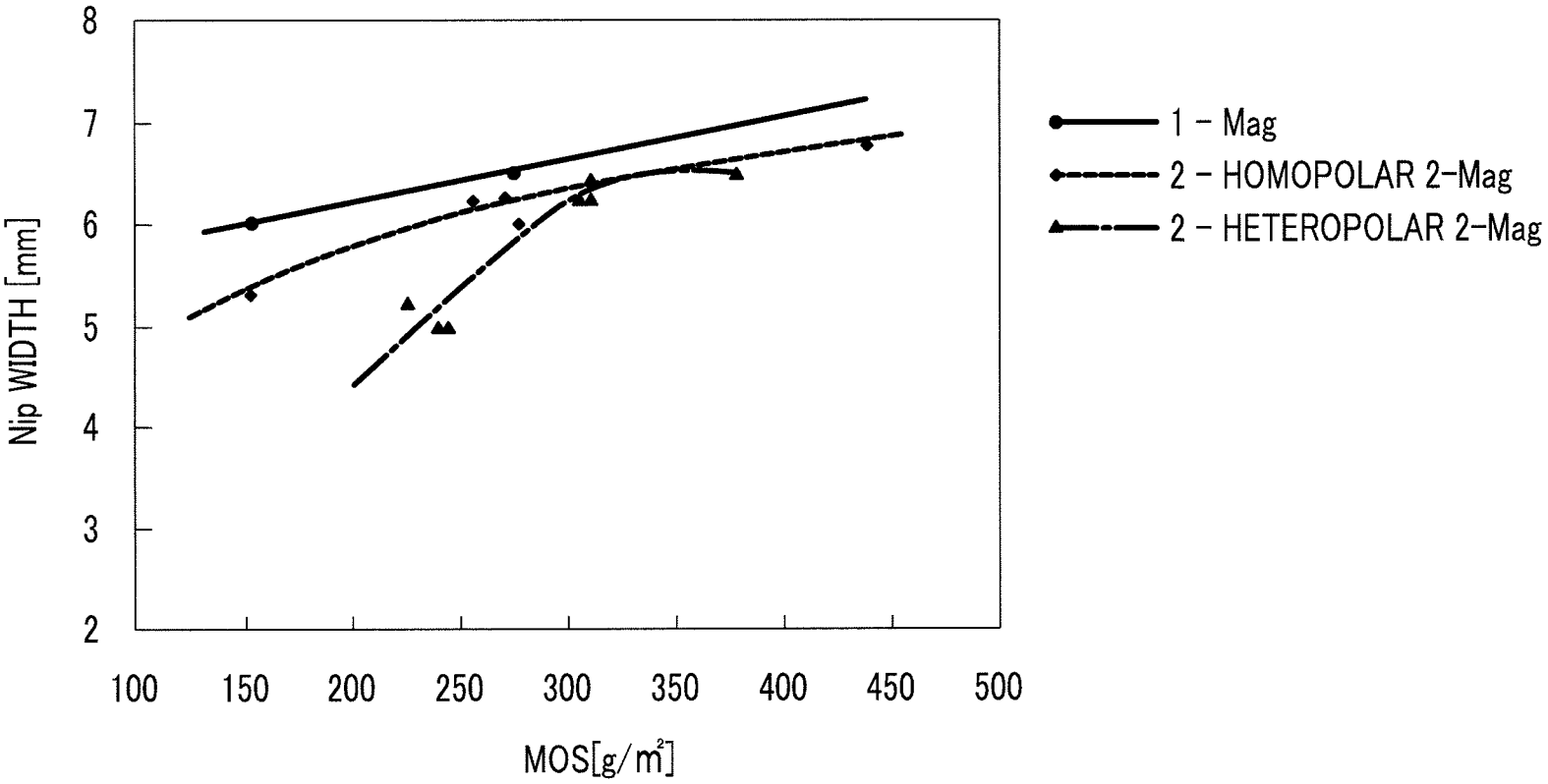
FIG. 8 is a graph illustrating relationships between MOS and the developing nip width in configurations of 1-MAG, homopolar 2-MAG, and heteropolar 2-MAG.
Figure 9:
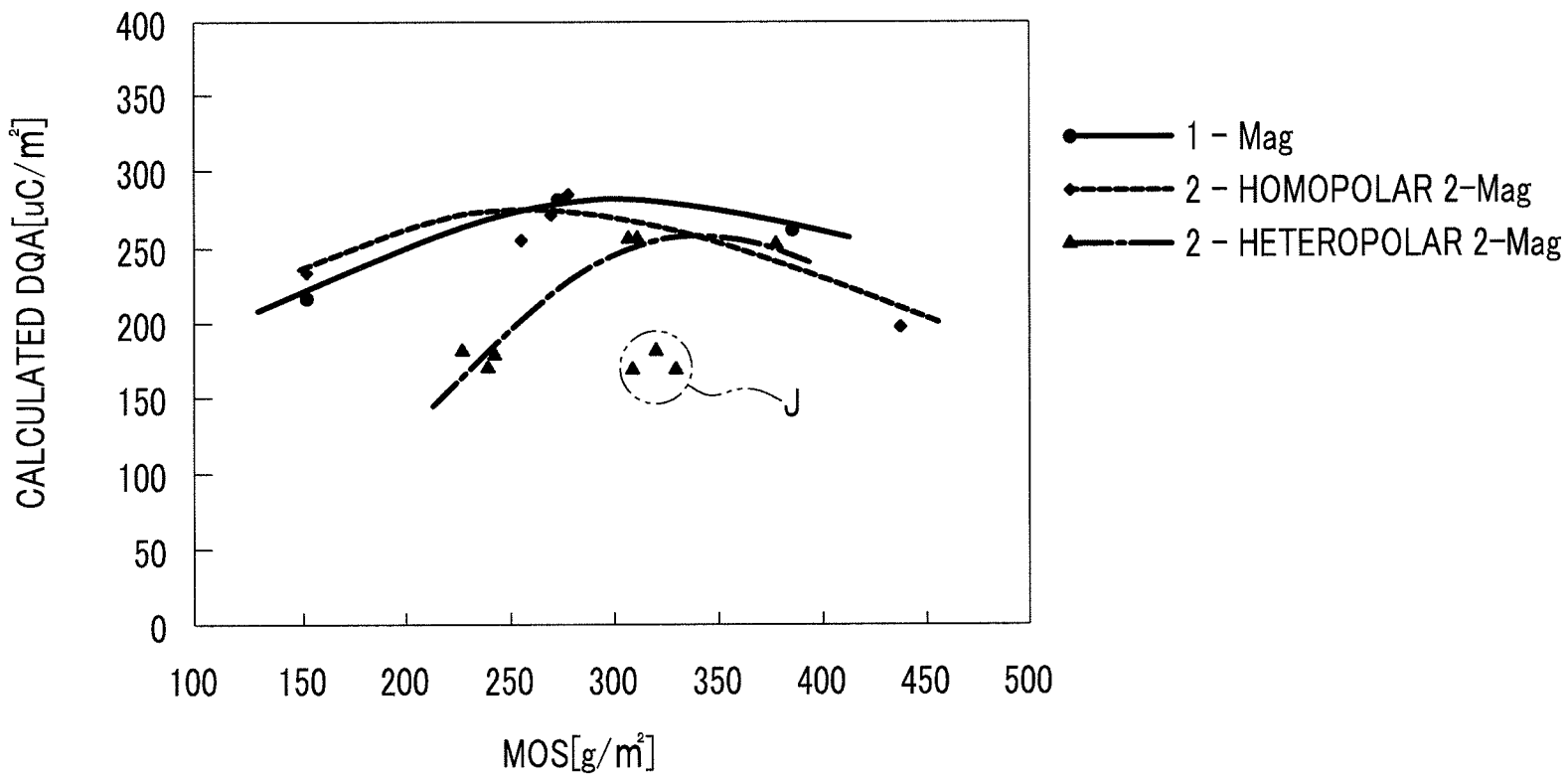
FIG. 9 is a graph illustrating relationships between MOS and the developing performance DQA in the configurations of 1-MAG, homopolar 2-MAG, and heteropolar 2-MAG.

The graph of FIG. 8 shows relationships between MOS and the developing nip width (the contact width in the circumferential direction) in the configurations of 1-MAG, homopolar 2-MAG, and heteropolar 2-MAG. The graph of FIG. 9 shows relationships between MOS and the developing performance DQA in the configurations of 1-MAG, homopolar 2-MAG, and heteropolar 2-MAG. In addition, in both FIGS. 8 and 9, the half-value width of the developing magnetic pole is set to about 30°.

It should be noted that the developing performance shown in FIG. 9 is developing performance of only the reverse rotation developing roller in both the 1-MAG configuration and the 2-MAG configuration. In other words, before the development performed by the forward rotation developing roller, measurement is performed on the developed toner image on only the reverse rotation developing roller.

As can be seen from the graph of FIG. 8, in the case of the heteropolar 2-MAG (comparative example) of which the developing magnetic poles have different polarities, compared with the case of the 1-MAG (only the reverse rotation developing roller), the developing nip width is greatly lowered. Further, the change in the developing nip width for MOS is large, and thus the developing nip is not stably formed. In contrast, in the case of the homopolar 2-MAG (the exemplary embodiment) of which the developing magnetic poles have the same polarity, compared with the case of the 1-MAG (only the reverse rotation developing roller), the developing nip width is only slightly lowered, the change in the developing nip width for MOS is small, and thus the developing nip is stably formed.

Further, as can be seen from the graph of FIG. 9, in the case of the heteropolar 2-MAG (comparative example) of which the developing magnetic poles have different polarities, compared with the case of the 1-MAG (only the reverse rotation developing roller), the developing performance DQA is greatly lowered. In contrast, in the case of the homopolar 2-MAG (the exemplary embodiment) of which the developing magnetic poles have the same polarity, compared with the case of the 1-MAG (only the reverse rotation developing roller), the developing performance DQA is only slightly lowered.

As described above, in the case of the comparative example in which the developing magnetic poles have different polarities, as shown in FIG. 6, the magnetic fields formed between the developing magnetic poles corresponding to each other are formed in the attractive direction. Thereby, the extending direction of the magnetic brush is directed toward the developing magnetic poles corresponding to each other, and the developing nip width is decreased. As a result, the development characteristics are lowered. In contrast, in the case of the exemplary embodiment, since the developing magnetic poles have mutually the same polarity, as shown in FIG. 5, the magnetic fields formed between the developing magnetic poles corresponding to each other are formed in the repulsive direction. Thereby, the extending direction of the magnetic brush is directed toward the photoconductor 12, and the developing nip width is stably secured. As a result, the development characteristics are improved.

Further, in the graph representing the relationships between the MOS and the developing performance DQA shown in FIG. 9, in the comparative example in which the developing magnetic poles have different polarities, the DQA is low even at the same MOS like the J region. This shows that, as shown in FIG. 6, magnetic fields formed between the developing magnetic poles having different polarities are formed in the attractive direction, the capability to transport the developer is lowered, and thus a transport error (jamming) of the developer occurs.

As described above, in the developing device 18 of the exemplary embodiment in which the developing magnetic poles have the same polarity, compared with the case of the comparative example of FIG. 6 in which the developing magnetic poles have different polarities, the developing nip width is stably secured and the development characteristic is improved. Further, the transport error of the developer G is prevented or inhibited. Furthermore, since the capability to transport the developer is improved, the volume of the developer G flowing into the developing regions (portions GP1 and GP2) is stable. Hence, the uneven density caused by the periodic change in the volume of inflow is inhibited or prevented from occurring.

Others

It should be noted that the present invention is not limited to the exemplary embodiment.

In the exemplary embodiment, both the magnetic pole S1, which is the developing magnetic pole of the reverse rotation developing roller 100, and the magnetic pole S1, which is the developing magnetic pole of the forward rotation developing roller 200, are formed as S poles, but the invention is not limited to this. Both may be N poles.

Further, for example, in the exemplary embodiment, the forward rotation developing roller 200 is disposed downstream of the reverse rotation developing roller 100 in the rotation direction of the photoconductor 12. However, the invention is not limited to this. The forward rotation developing roller 200 may be disposed upstream of the reverse rotation developing roller 100 in the rotation direction of the photoconductor 12.

Further, for example, in the exemplary embodiment, the number of magnetic poles of the magnet roller 120 of the reverse rotation developing roller 100 is seven, and the number of magnetic poles of the magnet roller 220 of the forward rotation developing roller 200 is five, but the invention is not limited to this. When the developing magnetic poles have the same polarity, the number of magnetic poles and the polarities of different magnetic poles are not limited to the exemplary embodiment.

Further, for example, in the exemplary embodiment, the magnetic pole N7 is provided between the magnetic pole S1 of the developing magnetic pole and the magnetic pole S6 of the delivery magnetic pole, but the invention is not limited to this. Plural magnetic poles may be provided such that adjacent magnetic poles have different polarities.

Further, for example, in the exemplary embodiment, the image holding member is a photoconductor having a drum shape, but the invention is not limited to this. The image holding member may be a belt-like photoconductor.

Further, the configuration of the image forming apparatus is not limited to the configuration of the exemplary embodiment, and various configurations may be adopted. For example, the image forming apparatus is a monochrome printing type, but the invention is not limited to this. The apparatus may be a color printing type. Furthermore, in the case of color printing, it may be possible to adopt a method in which each color toner image is transferred from the photoconductor 12 corresponding to each color to an intermediate transfer body such as an intermediate transfer belt and the images are collectively transferred onto the printing medium.

Moreover, it is needless to say that various embodiments may be made without departing from the technical scope of the invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a pair of developer holding members that comprising:

a pair of cylinder members, which are disposed close to each other and rotate in the same direction at an adjacent gap at which both cylinder members are in close proximity, the pair of cylinder members comprise a reverse rotation developing roller and a forward rotation developing roller, wherein the reverse rotation developing roller contains more magnetic poles than the forward rotation developing roller; and a pair of magnetic force generation sections which are provided inside the pair of cylinder members respectively and generate magnetic forces for holding a developer on the cylinder members; and a pair of developing magnetic poles that are provided in the pair of magnetic force generation sections respectively, are disposed to be opposed to a latent image holding member, and are set to have the same polarity.

2. The developing device according to claim 1, wherein the pair of magnetic force generation sections is provided with a pair of delivery magnetic poles, which are disposed to be opposed to portions thereof each corresponding to the adjacent gap and are set to have reverse polarities, and wherein one or a plurality of magnetic poles is provided between the delivery magnetic pole and the developing magnetic pole such that adjacent magnetic poles have different polarities, when the developing magnetic poles and the delivery magnetic poles have the same polarity.

3. The developing device according to claim 2, wherein the latent image holding member has a substantially cylindrical shape, and wherein the center positions of the pair of the developing magnetic poles are respectively provided upstream of a virtual straight line, which passes through a rotation center of the cylinder members and a rotation center of the latent image holding member having a substantially cylindrical shape, in a rotation direction.

4. An image forming apparatus comprising:

the developing device according to claim 2;

a latent image holding member that has a surface on which a latent image is formed and is visualized as a toner image by the developing device; and a transfer section that transfers a toner image, which is formed on a surface of the latent image holding member, onto a transfer target object.

5. The developing device according to claim 1, wherein the latent image holding member has a substantially cylindrical shape, and wherein the center positions of the pair of the developing magnetic poles are respectively provided upstream of a virtual straight line, which passes through a rotation center of the cylinder members and a rotation center of the latent image holding member having a substantially cylindrical shape, in a rotation direction.

6. An image forming apparatus comprising:

the developing device according to claim 1;

a latent image holding member that has a surface on which a latent image is formed and is visualized as a toner image by the developing device; and a transfer section that transfers a toner image, which is formed on a surface of the latent image holding member, onto a transfer target object.

7. An image forming method comprising:

visualizing a latent image, which is formed on a surface of a latent image holding member as a toner image by a developing device according to claim 1; and transferring a toner image, which is formed on a surface of the latent image holding member, onto a transfer target object.

8. The developing device according to claim 1, wherein a developing magnetic pole of the of the reverse rotation developing roller and a developing magnetic pole of the forward rotation developing roller are formed such that an angular width of a portion indicating a half value of a peak magnetic flux density is 30° or more.

9. The developing device according to claim 1, wherein the reverse rotation developing roller rotates in a direction opposite to a rotation direction of a photoconductor at a gap between the reverse rotation developing roller and the photoconductor.

* * * * *